United States Patent [19]

Nickerson et al.

[11] 4,094,264

[45] June 13, 1978

[54] QUICK-RELEASE, SURE-SET ANTI-FOULING ANCHOR

[76] Inventors: Richard W. Nickerson, P. O. Box 294; Thomas R. Nickerson, P. O. Box 654, both of Frazier Park, Calif. 93225

[21] Appl. No.: 820,044

[22] Filed: Jul. 28, 1977

[51] Int. Cl.[2] ..... B63B 21/24

[52] U.S. Cl. ..... 114/304; 114/310

[58] Field of Search ..... 114/294, 297–310

[56] References Cited

U.S. PATENT DOCUMENTS

| | | | |
|---|---|---|---|
| 2,722,191 | 11/1955 | Johnson | 114/304 |
| 3,022,762 | 2/1962 | Hillcourt | 114/306 |
| 3,263,642 | 8/1966 | Wilson | 114/297 |
| 3,491,712 | 1/1970 | Ross | 114/298 |

*Primary Examiner*—Trygve M. Blix
*Assistant Examiner*—D. W. Keen

[57] ABSTRACT

A quick-release, anti-fouling anchor that can be quickly and surely set in either of two positions, 180° apart comprising a shank, with an enlarged end portion containing a closed loop cam-like opening, two flukes shaped like truncated triangles, stocks or anti-roll bars extending at 90° angles from and attached to the flukes and joining them together so as to pass through the cut out section, two support rods joining the flukes and passing through the cut out section, two support rings are attached to the base of each fluke through which the rods pass, the rods and cam surface being in such relationship that a force exerted on the shank varies locks or unlocks the angle of the flukes according to the desired anchoring mode. Two obtuse cover angled plates mounted on each circular ring to act as trippings palms which position the flukes to dig into the bottom. A arcuate anti-fouling rod located on the shank, protects the mechanism from engagement by marine vegetation from above and two anti-fouling semi-circular rings mounted outwardly from the support rings protect either side of the mechanism from engagement with marine vegetation.

2 Claims, 11 Drawing Figures

QUICK-RELEASE, SURE-SET ANTI-FOULING ANCHOR

BACKGROUND OF THE INVENTION

1. Field of the Invention

This invention relates to marine anchors and particularly to anti-fouling, quick-release and quick re-setting anchors.

2. Description of the Prior Art

Since man's first attempts at navigation upon the water anchors of various types have been used to stabilize the means he has used for water transport and to position these means at convenient places.

Early anchors were large and heavy and are best illustrated by the fisherman or admiralty anchor and the Chinese anchor.

A need for a more efficient lighter weight and easier to handle anchors resulted in a study of anchor dynamics.

Formulas for anchor efficiency were developed. One of these used to determine anchor efficiency is $H = P/W$ in which the efficiency or holding power is designated as $H$. $P$ is the horizontal pull and $W$ the weight of the anchor. The result has been the development of a variety of anchors with large fluke surfaces. Such anchors are illustrated in U.S. Pat. Nos. 3,373,712; 3,327,673; 3,295,848; 3,407,776; 3,270,704.

These various patents follow the approach of designing an anchor mechanism that consists of two various shaped flukes designed to dig into the bottom and present the maximum drag to bottom surface materials. They have resulted in an anchor efficiency of 6 to 10. An example of such a lightweight anchor is the Danforth anchor.

Stokes U.S. Pat. No. 3,373,712 illustrates this approach but his device and that of Goodwin U.S. Pat. No. 3,327,673 are both subject to fouling by marine bottom plants and snagging on bottom rocks and debris.

Additionally, each anchor listed in the prior art suffers from the general disability of all anchors in that there is a general tendency of the anchor to turn over with an upward pull on the ring or if the ship swings from side to side.

OBJECTS AND ADVANTAGES OF THE INVENTION

It is an object of this invention to provide an anchor design that is quick-setting and will dig into the bottom surface as soon as a pull is exerted on the anchor line.

It is another object of this invention to provide an anchor that is quick-releasing by reversing the direction of pull.

It is still another object of this invention to provide an anchor that when it leaves the bottom will automatically assume a trim position to prevent hooking on marine growth, nets or rocky overhangs.

It is still a further object of this invention to provide an anchor that will reliably adjust itself to reverse its position and dig into the bottom if the tide or wind is reversed causing a pull on the anchor line in the opposite direction.

It is another object of this invention to provide an anchor device that can readily be maneuvered into a cross-hold or deadman position to improve holding power when needed.

It is still a further object of this invention to provide an anchor that will resist turnover with an upward pull on the ring or movement of the ship from side to side.

It is another object of this invention to provide a lightweight anchor that is of a simple, low cost design.

It is still a further object of this invention to provide a lightweight anchor with improved holding power.

Other objects and many attendent advantages will become apparent when considered in the light of the specification and accompanying drawings.

DESCRIPTION OF THE PREFERRED EMBODIMENT

Figure 1:
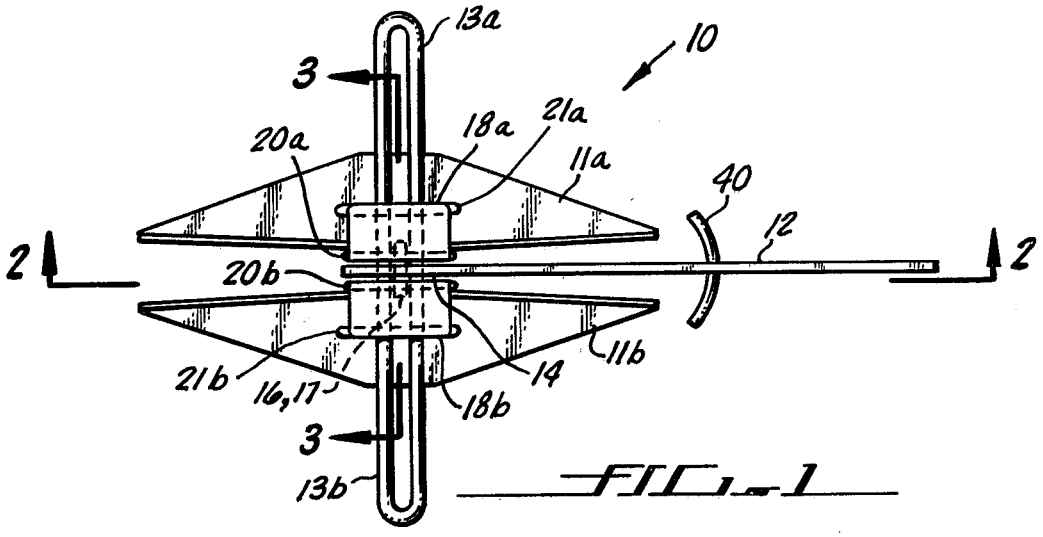
FIG. 1 is a plan view of the anchor.
Figure 2:
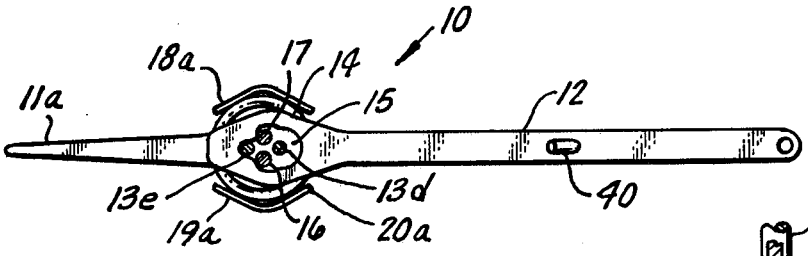
FIG. 2 is a section view through line 2—2.

Referring to the drawings in FIGS. 1 and 2, the anchor 10 of this invention is comprised of two flukes **11*a* and 11*b* which are roughly triangular shaped on each end so as to dig into the bottom surface. A shank 12 ends in a configuration (not shown) to which a shackle is fastened. A line or houser is attached to the shackle. An arcuate anti-fouling rod 40** is mounted on the shank just above the flukes to protect the mechanism from engagement with marine vegetation.

Two U-shaped stock bars **13*a* and 13*b*** are mounted to the flukes at right angles to the plane of the flukes and joined together at the center line holding the flukes in fixed relation to each other. The anti-roll bars are similar to the common anchor stocks and would be so identified by those skilled in the art of anchor making.

A center hub 14 at the extremity of the shank opposite that to which a line is attached contains a cut-out center portion 15 with cam-like properties. This center hub 14 can be attached to the shank 12 or be an enlarged end portion of shank 12.

The centers of stock bars **13*a* and 13*b* pass through the cam-like opening 15 and are identified in FIG. 2 as 13*d* and 13*e***.

Two rod-like structures 16 and 17 with a diameter slightly larger then that of rods **13*a* and 13*b* are mounted opposite each other on the flukes. These rod-like structures and the stock bars join the flukes together and pass through cam-like center portion 15**.

Four obtuse angled cover plates **18*a* and 18*b* and 19*a* and 19*b* serve a dual purpose. First they protect the mechanism from fouling by preventing marine growth from becoming engaged therein. They are mounted on two circular rods 20*a* and 20*b*** to which the flukes are attached at right angles. Secondly and more important they provide guide and support surfaces for the anchor as it digs into a holding position and also as it reverses to a holding position in the opposite direction. In this second function they act as tripping palms and position the flukes to dig into the bottom.

Figure 3:
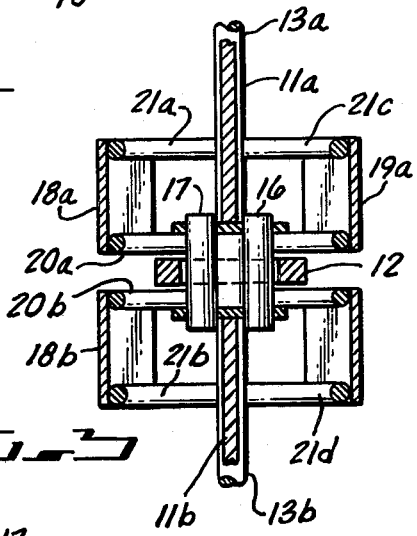
FIG. 3 is a section view through line 3—3.

FIG. 3 is a section through 3—3 of FIG. 1. This view shows the position of protective semi-circular rods 21*a*, 21*b*, 21*c* and 21*d* located outside of circular rods 20*a* and 20*b*, and attached to the flukes. These protective rods prevent marine vegetation from fouling the mechanism by entry through the sides of the anchor.

Figure 4:
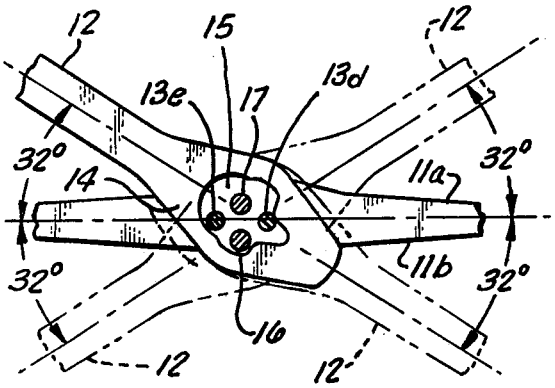
FIG. 4 is a partial section view through line 2—2 of the four positions of the shank in relation to the plane of the flukes, holding in each position.

FIG. 4 illustrates the four positions of the shank in relationship to the plane of the flukes limited by the cut-out can design 15 of this invention. Each possible position establishes a 32° angle between the shank 12 and the flukes 11*a* and 11*b* thus creating the maximum holding efficiency.

The Symmetrical configuration of the pins 16 and 17 and rods 13E and 13D allows the cut-out area in the shank to assume four different but identical positions in relation to the flukes.

Figure 5:
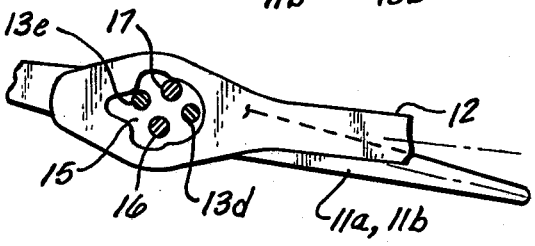
FIG. 5 is an enlarged section of the same parts in the hold position.

FIG. 5 shows the flukes 11*a* and 11*b* in a locked and holding position in relation to the shank 12. The areas 31*a*, 30*b*, and 32*b* are in contact with rods 13*e*, 13*d* and pin 16 establishing a positive lock for holding.

Figure 6:
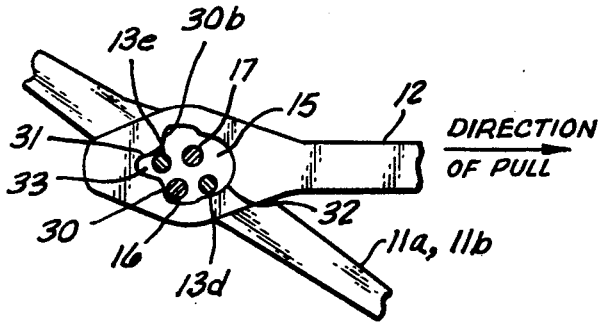
FIG. 6 is a partial section of the same parts in the rest position.

FIG. 6 shows the cut-out areas 15 and 33 after the anchor of this invention has been dropped to the bottom. Shank 12 and flukes 11*a* and 11*b* are nearly in line. Rods 13*d*, 13*e* and pins 16 and 17 are in a neutral position to the locking surfaces.

Figure 7:
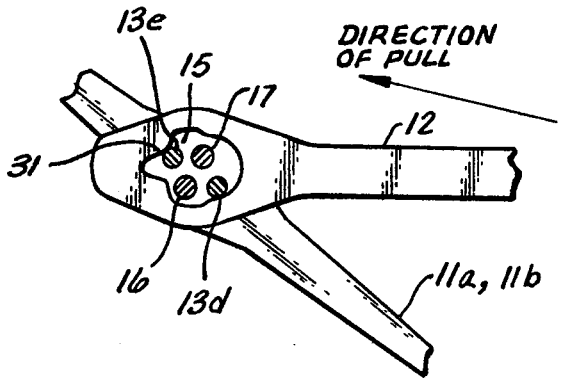
FIG. 7 is a partial section of the same parts in the locking position for holding.

In FIG. 7 a force has been exerted on the shank 12, moving it in the direction of the arrow. In area 15, 30*b* area engages pin 16, rods 13*e* and 13*d* lock positively against areas 31*a* and 32*b*, causing the flukes to be shoved forward and down and the tips of the flukes to dig into the bottom. At this same time the angle between the shank 12 and the flukes 11*a* and 11*b* will be 38° and the maximum efficiency of the anchor will be achieved.

Figure 8:
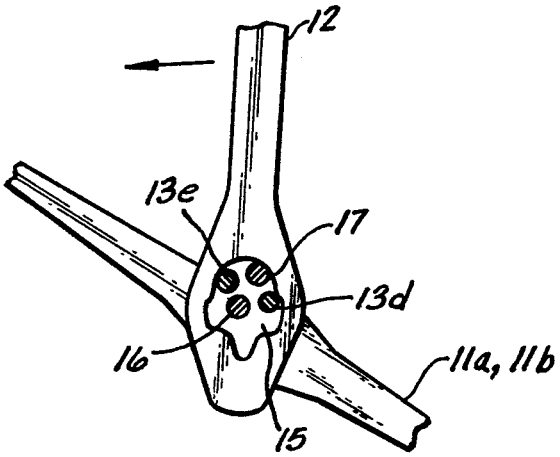
FIG. 8 is a partial section of the same parts in the beginning of the pull-out position.

FIG. 8 illustrates the unlocking or release of the anchor mechanism. When the pull on the anchor is slackened and the direction of pull reversed, the shank surface 31*a* is pushed clear of rod 13*e* and rotated in the direction indicated by the arrow.

Figure 9:
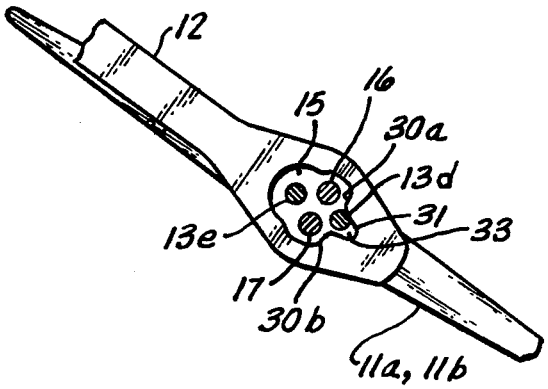
FIG. 9 is a partial section of the same parts towards a trim and pull-out position.

In FIG. 9 force exerted on shank 12, will cause rods 16 and 17 to engage cam surfaces 30 and 31 while 13*d* moves into area 33 which is in the shape of a U. This aligns the flukes with the shank. The interaction of rods 16 and 17 with shoulder areas 30*a* and 30*b* prevents misalignment of the flukes and shank during pull up. A moderate force will now disengage flukes 11*a* and 11*b* from the bottom.

Figure 10:
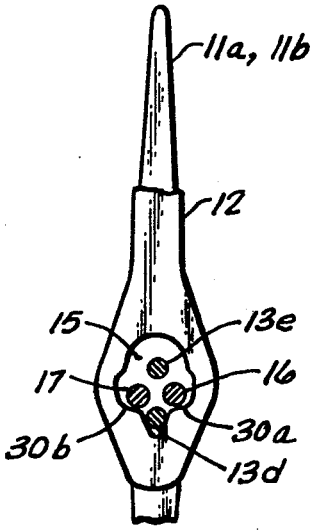
FIG. 10 is a partial section of the same parts in a trim and pull-out position.

FIG. 10 shows the trim position in which the flukes and shank are aligned to prevent catching on nets or becoming fouled with marine growth. This position is also best for storing the anchor.

Figure 11:
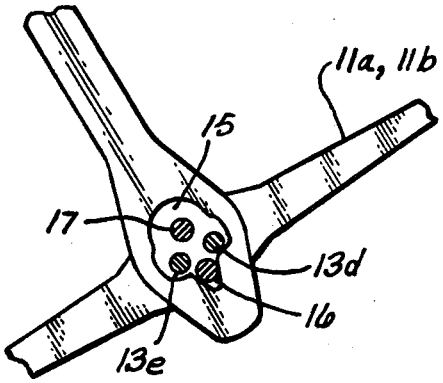
FIG. 11 is a partial section of the same parts in the crosshold or deadmans position.

In FIG. 11 the deadman hold or cross-hold is illustrated. This position is achieved by shortening the line and achieving the initial unlocking position illustrated in FIG. 7. Then tighten the line and pull in the holding position. This forces rod 16 into locking cam area 32 and increases the angle of the shank to the flukes to approximately 90°. This position is satisfactory for permanent mooring and is the strongest holding position.

By slackening the line and pulling in the pull-out direction the cam surface may be rotated around the rods increasing the angle from 90° to about 180° as is shown in FIG. 9. The anchor can then be easily pulled out.

One should note that if changing tide or shifting winds causes the boat to pass over the anchor it will pull out when the position in FIG. 9 is reached.

However, the anchor will then be in the reverse of FIG. 5 and continued pull will cause the anchor to tilt over on obtuse angled plates or tripping palms 18*a* and 18*b* and 19*a* and 19*b* and set flukes 11*a* and 11*b* into the bottom automatically resulting in a re-anchoring of the craft with a minimum of drift.

We claim:

1. A quick-release marine anchor comprising:

an attachment means;

a shank with an enlarged end portion on the extremity thereof opposite the attachment means;

said end portion axially cut-out to form a control means the forming edges of the cut-out control means being cam-like;

two flukes shaped like truncated triangles, one located on each end of the shank with the bases thereof parallel to the control means of the shank;

two U-shaped anti-roll rods or stocks attached at right angles to the center of the flukes and joined within the control means of the shank so that vertical forces applied to the shank cause the rod farthest from the enlarged end of the shank to engage the cam surfaces of the control means positioning the base of the flukes in parallel relationship with the shank;

two support rods joining the flukes at the center of the bases thereof and passing through the cut-out control means of the shank so that forces applied to the shank cause the rods to engage the control means cam surfaces positioning the base of the flukes at an angle greater than 30° and less than 40° on either side and parallel with the shank, such support rods being larger in diameter and located at right angles to the plane of the anti-roll rods one being above and one below said plane;

circular support and anti-fouling rings attached to the center of the base of each fluke the anti-roll and support rods passing through the center of said rings;

at least two plates mounted on each of the circular support rings parallel to the flukes which plates shield the cam-like control means and rods passing therethrough and act as tripping palms to form guide and support surfaces for movement of the anchor into the holding position and reversing the holding position;

an arcuate anti-fouling rod attached to the shank just above the upper end of the flukes to protect the mechanism from engagement with marine vegetation.

2. A quick-release marine anchor as described in claim 1, in which the cut-out control means is shaped at the end farthest from the enlarged portion of the shank like a ellipse cut in half at the center of the longest diameter open toward the enlarged portion of the shank and dimensioned to receive the anti-roll rod in sliding relationship;

angling at a 70° angle away from the ellipse, backward toward the apex of the ellipse are two surfaces which interact with the support rods rigidly positioning the base of the flukes in a position parallel to the shank when the anti-roll rod is in position in the apex of the ellipse;

a surface in diameter equal to 1½ times the diameter of the support rods, parallel to the long diameter of the ellipse extending away from the apex of the ellipse is joined to each of the 70° surfaces by a concave arcuate surface dimensioned and shaped to receive the support rods;

these two surfaces end in a concave arcuate surface of 5° which join other two plane surfaces 1¼ times the diameter of support rods which are at an angle of 20° with the long diameter of the ellipse and dimensioned so that the anti-roll rod farthest from the apex of the ellipse is engaged by one of these surfaces while the opposite rod is engaged by one of the walls of the ellipse and a support rod is engaged with arcuate surface joining the ellipse with 70° angling surfaces causing the flukes to be positioned at an angle greater than 30° and less than 40° on either side and parallel with the shank;

a concave arcuate surface joining the ends of these two surfaces farthest removed from the apex of the ellipse complete and closes the cam-like cut-out control means.

* * * * *